United States Patent [19]

Grieb

[11] Patent Number: 4,774,794

[45] Date of Patent: Oct. 4, 1988

[54] ENERGY EFFICIENT BUILDING SYSTEM

[76] Inventor: Donald J. Grieb, 3101 W. Mill Rd., Milwaukee, Wis. 53209

[21] Appl. No.: 588,323

[22] Filed: Mar. 12, 1984

[51] Int. Cl.[4] ..... E04C 1/00

[52] U.S. Cl. ..... 52/309.7; 52/309.4; 52/309.8; 52/309.9; 52/309.12; 52/309.16; 52/309.17; 52/410; 52/586; 52/589; 52/593; 52/594; 52/595; 52/612; 52/659

[58] Field of Search ..... 52/309.7, 309.8, 309.9, 52/309.16, 309.4, 612, 309.12, 309.17, 589, 586, 593, 595, 594, 410, 659

[56] References Cited

U.S. PATENT DOCUMENTS

| | | | |
|---|---|---|---|
| 3,110,981 | 11/1963 | Larner | 52/309.12 |
| 3,119,204 | 1/1964 | Williams | 52/309.12 |
| 4,053,677 | 10/1977 | Corao | 52/309.12 |
| 4,067,164 | 1/1978 | McMillan | 52/309.12 |
| 4,084,362 | 4/1978 | Piazza | 52/309.12 |
| 4,186,536 | 2/1980 | Piazza | 52/309.12 |
| 4,229,491 | 10/1980 | Piazza | 52/309.12 |
| 4,292,783 | 10/1981 | Mulvihill | 52/309.2 |

*Primary Examiner*—Janyce A. Bell
*Attorney, Agent, or Firm*—Ronald E. Barry

[57] ABSTRACT

A foam-cement building having the walls, roof and/or floor formed from a plurality of self supporting foam building blocks of varying density with a strong thin continuous structural and architectural coating on the surface of the blocks, the coating being formed from cement, reinforced with a fiberglass mesh and fiberglass roving strands, the blocks being interconnected by a mechanical key system or splines to form a monolithic structure.

26 Claims, 5 Drawing Sheets

ENERGY EFFICIENT BUILDING SYSTEM

BACKGROUND OF THE INVENTION

The use of foam panels in the construction of buildings to improve the insulating characteristic of the walls is well known. Generally, the buildings are constructed with a wood frame construction set on a masonry foundation with insulation between the wall studs and roof rafters.

SUMMARY OF THE INVENTION

The building according to the present invention is constructed from cement-foam structural blocks or panels four feet wide, sixteen to twenty feet long and six to twenty-four inches thick and of structurally related foam densities. The strength of the blocks is enhanced by providing a coating of fiberglass reinforced cement on the outside surface and on the inside surface where required. The blocks can be used in the construction of the walls, the foundation, the roof and the floor to form a completely enclosed structure. The blocks can be pre-cut according to the building plan, covered with the fiberglass reinforced cement composition, transported to the job site and assembled at the site. The junction between the blocks can be formed by a mechanical key system, wood splines or a concrete rib or can be reinforced with a wire mesh. The fiberglass reinforced cement on the surface of each block provides weather resistance and increased structural strength which in combination with the foam strength can support loads in excess of the wind, snow, dead and live loads required for conventional loading by standard building codes.

The use of structural cement-foam building blocks to construct a building provides high insulating values for the walls, roof and floor as well as a very strong, light weight, easily assembled construction. The blocks have fire resistance characteristics both inside and out with zero flame spread surfaces. The surface materials are tough and can be easily repaired if damaged. The walls are very economical to manufacture and have "R" values of 80 to 160 with a wall thickness of 20 inches. A variety of surface finishes can be provided on the blocks, including stucco, brick, wood, ribbed and sculptured surfaces to name a few. Piping and wiring systems can be simply and easily installed at the building site. The foam blocks as well as any wood structural members are treated against rodents or termites as well as fires and rot.

IN THE DRAWINGS

DESCRIPTION OF THE INVENTION

Figure 1:
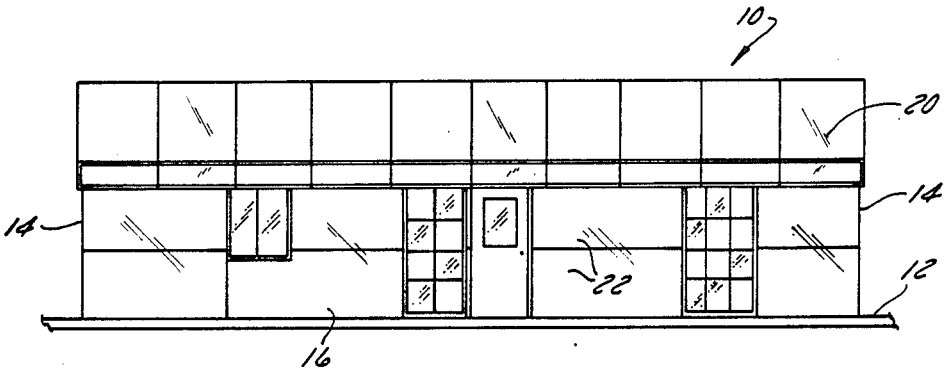
FIG. 1 is a front elevation view of a building constructed according to the invention.
Figure 2:
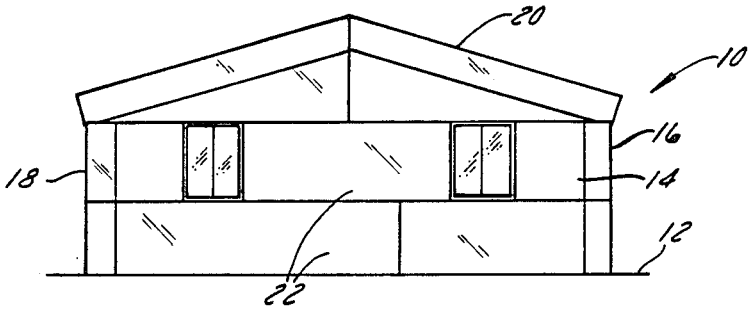
FIG. 2 is a side elevation view of FIG. 1.
Figure 3:
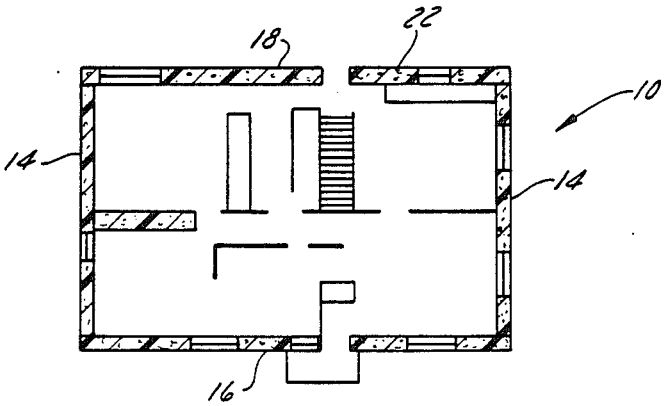
FIG. 3 is a top plan view of the building in FIG. 1 with the roof removed.

Referring to FIGS. 1, 2 and 3 of the drawings, a simplified representation of a building 10 constructed according to the present invention is shown having a floor or base 12, side walls 14, a front wall 16, a rear wall 18, and a roof 20. Although the building shown in the drawing is in the form of a house, it should be understood that the blocks can be used for commercial and industrial buildings as well as residential buildings. Each of the walls is formed from a number of foam-cement blocks 22 which have high load-bearing characteristics and insulating and flame-spread properties superior to most conventional wall structures. In this regard it should be noted that the blocks are self-supporting in that no supporting frame is required for the construction of the walls of the building. The roof and floor slabs are capable of spanning a distance between walls of 16 to 20 feet, however, a support beam or wall is recommended for greater distances.

The blocks 22 which are used to form the walls, roof and floor of the home are shown in FIGS. 4, 5, 6 and 7. Each wall block includes a beaded or extruded cellular foam core 24 having a thickness of six to ten inches for interior walls and twelve to twenty-four inches for the outside walls, with a standard four foot width and an eight to sixteen foot length. The load bearing blocks for the outside walls should be formed from an extruded cellular or beaded foam material having a density of at least two pounds and a minimum thickness of 12 to 14 inches. The length can be varied to accommodate variations in the home dimension and design. Various foam materials such as extruded and expanded polystyrenes, phenolics, and polyisocyanurate foams of various specific densities, depending on the load carrying capacities, have been used.

The foam core can be used for the walls, roof, and floor of the building. The foam core provides compressive, tensile and flexural strengths that are satisfactory for these purposes. A 12 to 14 inch foam polystyrene core has a resistance to thermal heat transfer of R-58 to 60 and acts as a good moisture vapor barrier. Most of the foam materials are frost and moisture resistive, termite-free and can be cut to any desired shape, curved, rectangular, textured and contoured surfaces. The load-bearing characteristic of the foam core 24 has been increased significantly by providing means in the form of a thin fiberglass reinforced cement coating 26 on the outer and/or inner surface of the panels with a fiberglass mat reinforcement laid over each surface prior to applying the coating to each block.

Figure 4:
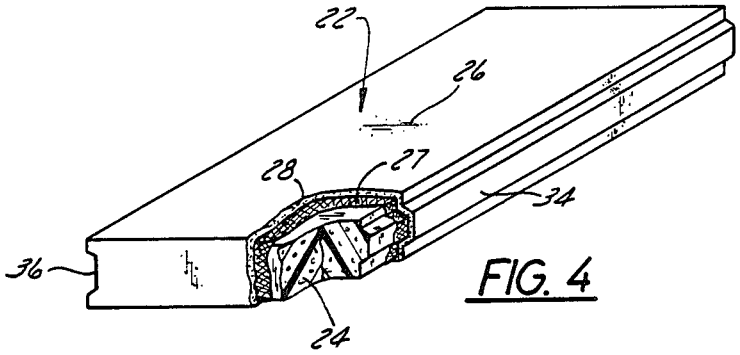
FIG. 4 is a perspective view of the cement-foam block used to construct the building of FIG. 1 having a tongue and groove end connection with a portion broken away to show the cement-foam structure.

In this regard, and referring to FIG. 4, a portion of one of the foam-cement blocks 22 is broken away to show the coating 26. The coating 26 is provided on the entire outer surface of the core 24 and is formed by attaching a fiberglass fabric or mat 27 on the surface of the core 24 and then coating the fabric with a cementitious material 28 as described hereinafter. The coating 26 as shown forms a solid layer approximately ¼ to ½ inch thick minimum on the entire surface of the foam core. It should be understood that the coating 26 is applied only to those surfaces of the foam core as required by the building design.

The increased strength of the blocks was confirmed as a result of a test of a 2# density block of foam made on a 10 foot long, 24 inch thick X 4 foot wide 2# density foam (EPS) block having a ¼" to ⅜" thick cementitious coating applied over a 3/16×3/16" fiberglass mat on each of the 4×10 foot surfaces. A load of 40 sq. ft. was placed on the block and a test of its deflection of 0.35 inches measured at its center during this period.

The coatings 26, used for the structural surface of the foam blocks includes a single layer 27 of fiberglass reinforcement fabric having a 3/16"×3/16" grid, the basic cementitious material 28 includes Portland cement, sand, water and ½" to ¾" cut (treated), fiberglass roving strands. These ingredients are mixed with water, to which is added a liquid polymer adhesive acrylic material. There are also several similar packaged cementitious cement stucco-like prepared compounds with adhesive polymer admixtures which have similar structural strengths. These compounds can be used with certain reinforcement mats and cut roving fiberglass to coatings on the 2# density block to form structural building blocks for use in the foam-cement block buildings.

A typical admixture for the cementitious structural coating contains the following:

1 bag Portland cement (white or gray) 94 lbs.,
1½ parts sand—150 lbs.,
1 lb. cut fiberglass roving added to the sand and cement,
4 gallons water (additional as needed for plastic mix),
1 gallon polymer adhesive acrylic material.

This mixture is laid over the fiberglass reinforcing mat and penetrates the mat to bond the mat to the surface of the foam blocks. A structural finish surface bonding cement may be applied to the coating 26 to provide a color to the coating. The foam block 24 may be prime-coated with an adhesive polymer to increase the bonding characteristic of the foam block to the cementitious material 28.

Figure 10:
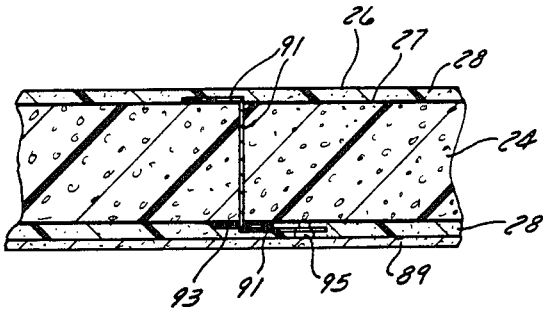
FIG. 10 is a view in section of a single wire mechanical tie.
Figure 11:
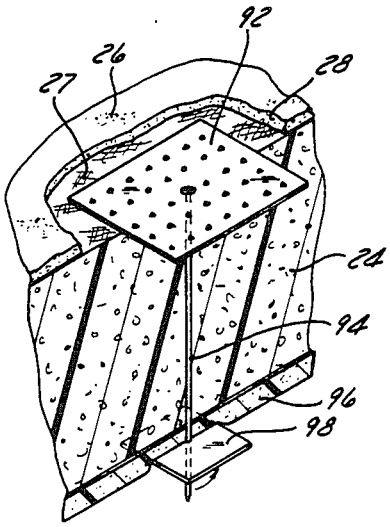
FIG. 11 is an isometric view of one form of throuh-wall tie used to support an inner wall.
Figure 12:
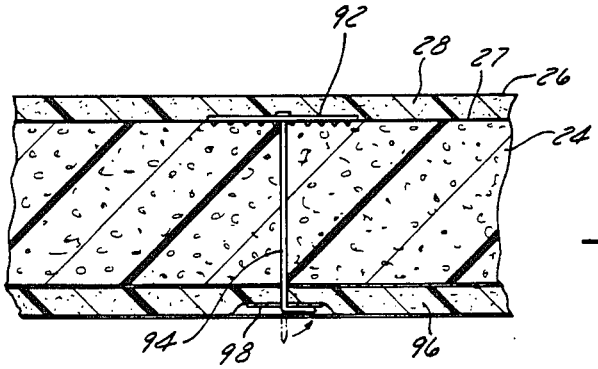
FIG. 12 is a side view in section showing the tie of FIG. 11.

An alternative coating for a fifteen to twenty-five minute fire or heat barrier to protect the interior surface of the foam block is made by substituting a catalyzed magnesium oxychloride mixture, Pyrocrete LD or Pyrocrete 201 made by the Carboline Co. of St. Louis, for the cement and sand in the above formula. Cut fiberglass roving strands and adhesive polymer are added to the mixture and mixed thoroughly prior to installation. The fiberglass reinforcement mat is attached to the interior surface of the foam block prior to the application of the barrier material as described above. An alternate thermal barrier can be provided by mounting a ½" to ⅝" gypsum board to the walls and/or roof-ceiling by means of an adhesive and thru wall ties on 24" centers. The thru wall ties for the roof block are spaced at the designed intervals for the roof dead and live loads (as shown in FIGS. 10, 11 and 12).

The addition of the cementitious or thermal barrier coatings to the foam blocks develops super strong load bearing strengths which also makes the blocks capable for use as a simple roof slab or floor plank. The coatings are sun resistant, frost-free and non-cracking. The coating can be modified to a variety of surface textures and colors with added color mixes for color styling.

Figure 13:
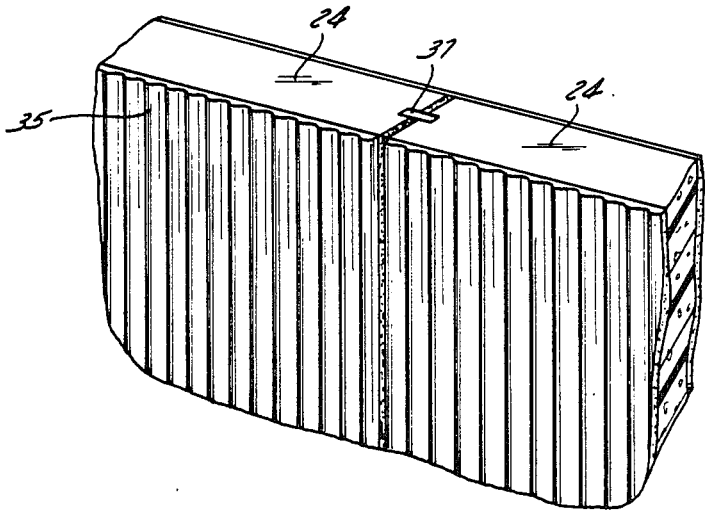
FIG. 13 is a perspective view of a portion of an outer wall having a corrugated textured wall surface.

Various surface designs and textures formed by the coatings can become both a decorative architectural finish and a further increased structural strength advantage to the building system and blocks. A ¼" to ⅜" verticle corrugated lineal surface 35 (FIG. 13) can be applied in plant or on field job site where such treatment is required or desired. Use of the corrugated surface allows for vertical expansion joints 37 between block at joints. Another surface treatment of cement coating allows for a surface to appear as a brick wall by (a) use of a mold impressing a brick joint and texture simulating real brick on each block's wall surface and (b) use of several tile and thin brick manufactured clay brick or cement brick by "Real Brick", Inc., Corunna, Michigan, California Driftwood Brick and Stone, Stucco Stone Products, Napa, California, or "Brickettes" Modern Methods Co., Owensboro, Ky. The use of a cut stone chip, gravel pebbles, merimac stone ¼" to ½" and stone of varied colors can be sown or imbedded in the finished surfaces exposed to view.

The walls are formed by merely placing the blocks in a vertical or horizontal relation one on top of the other. It should be understood that the blocks 22 are preformed and, therefore, can be manufactured to exact sizes and shipped to the building site to construct the house. Various means are provided in the structure of the blocks for interconnecting the edges of adjacent blocks. It should also be understood that the fabric mat can extend outward from the edges of the core for attachment to the edges of the mat in adjacent blocks.

In this regard and referring to FIGS. 4 through 7, various types of joints are shown. In FIG. 4, the blocks shown can be interconnected by means of a tongue 34 and groove 36 type joint. Generally this type of joint includes a groove 36 in one edge and a tongue 34 in the other edge of each block. The tongue and groove being inter-engagable to provide the joint. Normally an adhesive compatible with the cementitious material, such as R. N. Fuller Max Bond, Dap foam adhesive, and, Type M mortar, or a 2 part Grieb epoxy adhesive can be applied to the edges to seal the blocks together.

Figure 5:
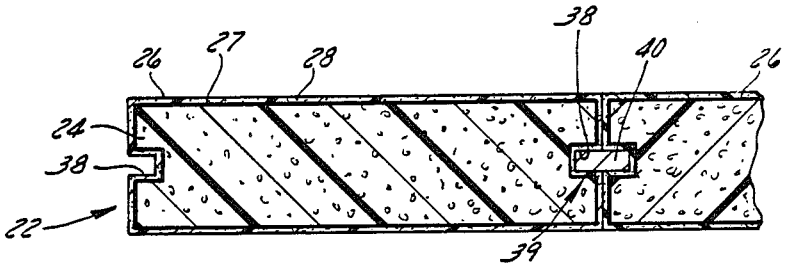
FIG. 5 is a cross section view of an alternate form of end connection for adjacent blocks.

In FIG. 5, the blocks are connected by means of a continuous spline joint 39 which is formed by cutting a groove 38 in each edge of the foam block and placing a rigid member 40 in the groove. An adhesive 41 is used to fill the groove and coat the edges to secure the blocks together.

Figure 6:
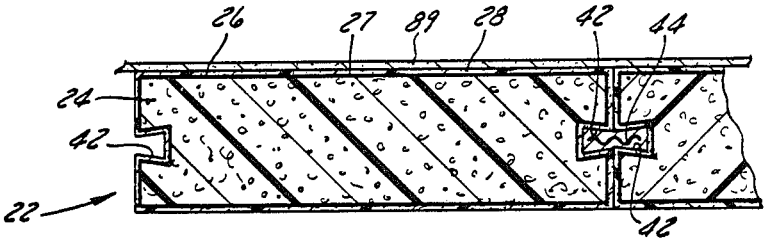
FIG. 6 is a cross section view of another alternate form of end connection for adjacent cement-foam blocks.

In FIG. 6, the blocks are connected by means of a key joint which is formed by undercutting a groove 42 in each edge of the block and placing a metal reinforcing bar or wire metal reinforcement strip 44 in the groove. The groove 42 is filled with cement and the edges coated with cement to secure the edges together.

Figure 7:
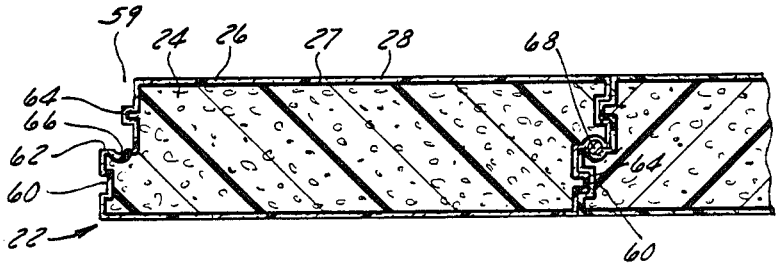
FIG. 7 is a cross section view of another alternate form of end connection for adjacent cement-foam blocks.

In FIG. 7, the blocks are connected by means of a mechanical joint which requires an offset cut 59 on each edge of the blocks to form a shoulder 62. Each edge is provided with a groove 60 in the lower half and a tongue 64 in the upper half. The joint can be increased in strength by providing a circular groove 66 in the shoulder 62 and placing a circular steel reinforcing rod 68 in the groove 62 when the blocks are placed in abutting relation. The blocks can be secured together by means of the rod. A bond beam may be made at the top of the wall or at height intervals of 8 to 10 feet to prevent outward distortion of the walls. The bond beam is formed by means of a wood or metal reinforcing bar placed in a continuous groove in the top of the wall and secured therein by the cementitious material. The bond beam can be formed by means of a continuous lapped, staggered 2"×6" joint double beam placed in the spline joint 39.

The floor 12 can also be formed of a number of cement-foam planks 70 which can be formed to span the full width of a 16 to 18 foot space over a crawl or basement space. Each plank 70 includes a cellular plastic core 72 six to twelve inches thick depending on the supporting structure. A fiber reinforced cement coating 74 on the bottom of the core for on-grade construction. A fiberglass cement coating can also be applied to the upper surface of the plank if desired, however, the upper surface is normally laminated with plywood or similar floor covering which will then be fully supported by the load-bearing surface of the plank. The edges of the planks 70 can be interconnected by any one of the connecting means discussed above.

Means in the form of mechanical fasteners can be provided in the blocks to attach wallboards 89 such as plywood, gypsum, masonite, cement, etc. to the surfaces of the foam-cement blocks, in order to meet code requirements. Such means as seen in FIG. 10 can be in the form of mechanical thru-wall ties wherein galvanized sheet metal or surface bent wires 91 are embedded in the core on 16 to 24 inch centers. The wire 91 is bent at right angles and anchored in the exterior surface coating 26. The inner end of the wire 91 extends through a galvanized washer 93 and bent over to support a drywall screw attachment 95 to fasten interior or exterior board and panel materials. An adhesive coating mastic material is also used to secure the panel boards to the foam block.

A second form of thru-wall tie 90 is shown in FIGS. 11 and 12 wherein a perforated 2"×2" sheet metal plate 92 is placed on the fiberglass fabric and a wire nail member 94 driven through the foam core to pierce the interior wall board 96 at intervals of approximately 2 feet on center. The wire is capped with a 1" galvanized plate-like washer 98 with a friction fit on the inside of the interior wall board 96. The wire end is then bent over the washer 98, indented and covered with a finish tape filler. The plate 92 is covered with the cementitious material 26 or a cement finish filler.

A third thru-wall tie is a piercing material made from a cut piece of steel band box-crating steel bent at right angles to face on the outer surface of the board. This type of tie material can also be used as a tension tie running vertically from roof to foundation or floor. A vertical tie rod or metal wire ladder could also be set in the outside of the core and secured therein by the cementitious material. Special joint clamps can also be used as tension ties for long runs of steel band ties.

Figure 8:
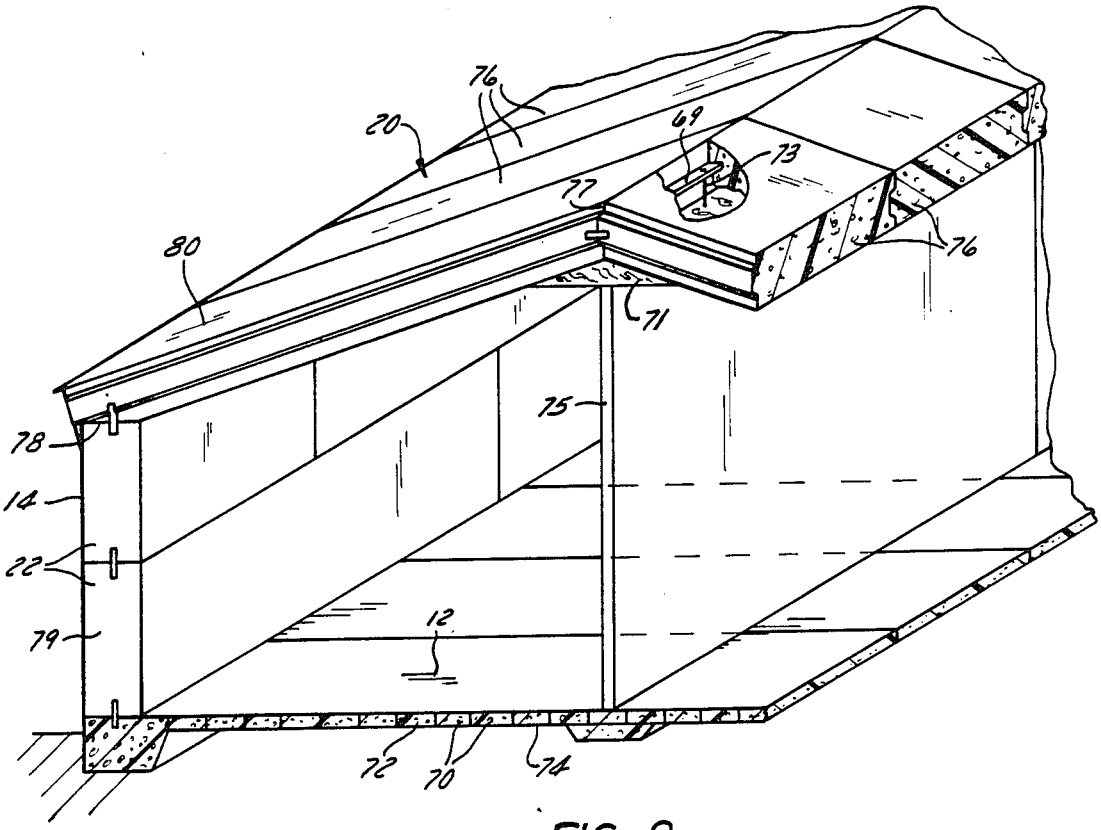
FIG. 8 is an isometric view of a position of a cement-foam house showing a block for the roof having a tongue and groove type junction.
Figure 9:
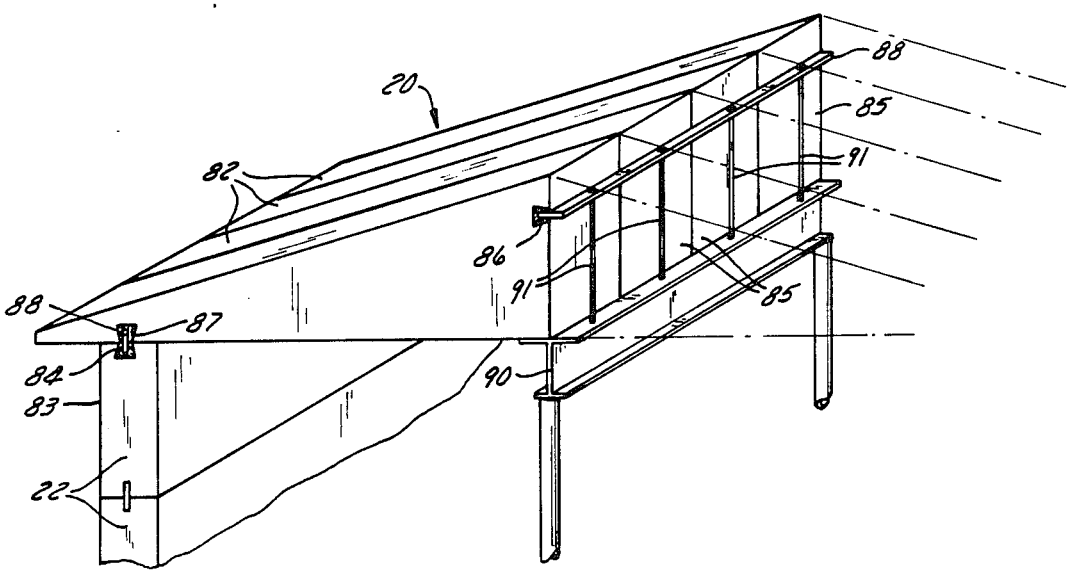
FIG. 9 is an isometric view of an alternate form of roof structure using roof blocks of triangular cross section.

The roof can be constructed either of individual blocks similar to the wall blocks as seen in FIG. 8 or as solid blocks having a triangular cross section as seen in FIG. 9. Referring to FIG. 8, the roof 20 is shown formed by means of a number of blocks 76 which are substantially identical to the wall blocks 22. The edges 77 at the upper end are angled to matingly engage the corresponding roof block 76 on the other side. A wood spline 69 is provided at the angled junction supported by an interior wall 75. The interior wall 75 can be of conventional construction or made of thin foam blocks as desired. A supporting surface 78 is provided at the lower end to engage the upper surface of the exterior supporting walls 79. A wood T-support ledge 71 is provided on the top of wall 76. Tie-down connections in the form of nails, bolts or wire rods 73 on two to four foot centers are provided between the wood spline 69 and the wood support ledge 71. After the panels 76 have been interconnected at their joints to form a monolithic structure, the upper surface can be sealed either by means of a fiber reinforced cement coating 80 provided across the entire surface, or plywood sheets or shingles applied.

In FIG. 9 a simple roof structure is shown formed from a number of solid blocks 82 which have a triangular cross section to provide the proper pitch for the roof. The ceiling and exposed surfaces of the blocks 82 are coated with ¼ to ½ inch cementitious material having a reinforcement mesh embedded therein. The blocks 82 are placed in side-by-side abutting relation and are cemented together to form a monolithic structure. Means can be provided in the back wall 85 of the block 82 for connecting the back 85 of the roof blocks to the back of the adjacent roof blocks. Such means is in the form of a groove 86 in each block and a rigid member 88 which is seated in the groove 86 of adjacent blocks. Appropriate adhesive or cement can be applied to interconnect the roof blocks. The blocks 82 are mechanically connected to the top of walls 83 by means of a rigid member 88 positioned in a groove 84 in the wall blocks surface 22 and a groove 87 in the roof blocks. A groove can also be provided in the bottom of the roof blocks at each end to provide a continuous spline joint with the top of the wall. The roof blocks can be supported by an I-beam 90 at the center as seen in FIG. 9 or by an interior wall formed of foam-cement blocks. A tie down connection is provided between member 88 and beam 90 by means of rods 91.

A mechanical air exchanger is provided in the completed building to provide continuous or periodic changes of air. Because of the tight joints provided in the building blocks an air infiltration is reduced to a minimum and proper exhaust and fresh air is supplied by the air exchanger.

Tests made on blocks 4'×10'×24" and blocks 14"×12"×16' also revealed a great load carrying capacity with minimal deflections over 31 day periods. The blocks were tested with 40#/sq. ft. uniformly distributed loadings. The 16' test block had a (max.) 0.35 inch deflection at its center span.

A test of a triangular cross-section roof block, approximately 4 feet×4 feet on each side and 6" thick with cementitious (reinforced with fiberglass) coatings of ⅜" on top and bottom triangular faces was conducted to determine the compressing strength of the block. An 18" diameter steel plate loaded with 400 lbs. which is equivalent to a uniform load of 40#/sq. ft. produced no deflection. Loading was increased gradually at five minute intervals to 2000 lbs. causing the cement surface to crack at 3 radial points. No through breakage of the foam was noted. This panel has been in a test condition since the load test outdoors in continual exposure to sun, rain and freezing with little noted damage to the foam or the coatings in Milwaukee, Wis.

Figure 14:
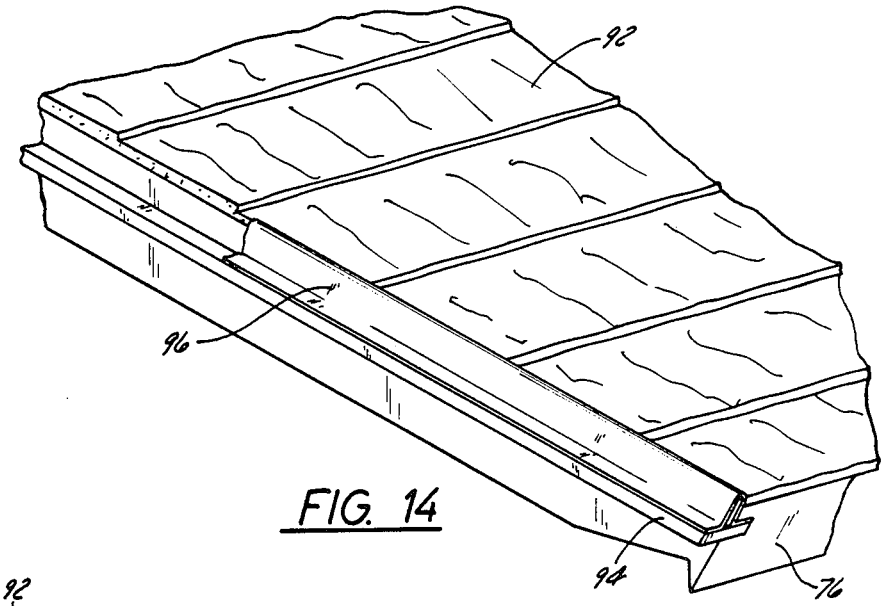
FIG. 14 is a perspective view of a portion of a roof having a shake shingle texture.
Figure 15:
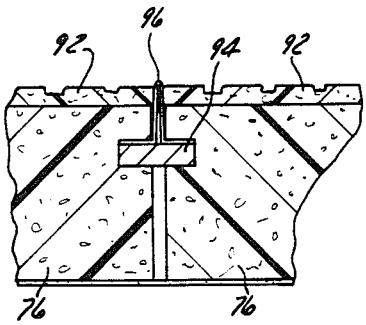
FIG. 15 is an end view of a roof joint between the panels of the roof shown in FIG. 14.

The roof block can also have stones imbedded into the surface coatings of light or dark colors to conform to architectural styling. A shingle mold form (FIGS. 14, 15) can be used to create a split-shake shingle 92 appearance at the same instance adding certain structural, fire safety and weather protection. If spline joints 94 are provided between the blocks 76, a metallic or plastic flashing 96 can be placed on the spline 94 which can expand and contract with the blocks.

The structural strength produced with the 2# density EPS blocks and the coatings formed by the fiber mat and fiber reinforced cementitious acrylic polymer mixture has proven to be sufficient to permit the blocks to be used to support high loads with a minimal or low weight factor of the blocks themselves. This is believed to be due to the fact that the foam-cement block is by design a composite material that has a structural strength caused by the homogenous nature of the foam load bearing core and the integral bond of the fiber reinforced cement skins. The shear transfer of the cement skins is transferred by the bond to the foam core and thus eliminates the need for mechanical shear connections.

The embodiments of the invention in which an exclusive property or privilege is claimed, are defined as follows:

1. A building formed from a number of load-bearing preformed insulating blocks, said building comprising a floor formed by a number of preformed insulating blocks joined at the edges to form a continuous floor, a number of walls supported on said floor, each of said walls being formed from a number of preformed insulating blocks joined at the edges to form a continous wall and a roof formed by a number of performed insulating blocks joined at the edges to form a continuous roof structure and being supported on said walls, said insulating blocks being formed from a molded foam and a fiber reinforced cement coating covering the entire exterior surface of said roof, said walls and said floor, and adhesive means joining said edges of the blocks to form said walls, roof and floor.

2. The building according to claim 1 wherein some of said blocks include a tongue on one edge of the block and a groove on the other edge of the adjoining block to form a tongue and groove connection when with the edges of adjoining blocks are positioned in abutting relation.

3. The building according to claim 1 wherein some of said blocks include a groove on the edges of said blocks and a spline positioned in said grooves to form the joint.

4. The building according to claim 1 wherein some of said blocks include an offset cut in each edge of said blocks which is symmetrical to the opposite edge, a circular groove in the offset surface and a rigid member placed in said circular groove on connection of said blocks to form a rigid mechanical joint.

5. A composite load-bearing building block adapted be joined in edge to edge relation with a corresponding block to form a wall, roof or floor, said block comprising a foam core having a sufficient width to form a load-bearing structure and a coating on at least one surface of said core, said coating being formed from a composition including Portland cement, sand, cut fiberglass roving strands and a polymer adhesive, said composition being applied to a reinforcement grid located on the outer surface of said core, whereby said grid is embedded in said cementitious coating.

6. The building block according to claim 5 wherein said grid is formed from a fabric having 3/16×3/16 openings.

7. The building block according to claim 5 or 6 wherein said fiberglass strands are combined with the cement in a ratio of 1 lb. to 94 lbs.

8. The builing block according to claim 5 or 6 wherein said core is 6 to 24 inches thick.

9. The building block according to claim 5 or 6 wherein said coating is applied to both the exterior and interior surfaces of said core.

10. The block according to claim 5 or 6 including a wall board mounted on a surface of each block and means embedded in said block for providing a mechanical tie through said core for said wall boards.

11. A load-bearing thermally insulating fire-resistant building wall formed from preformed blocks joined at their edges to form a continuous wall, each block comprising a foam core having a thickness of 6 to 24 inches and a coating on the inside and outside surfaces of said core, said coatings including a fiberglass reinforced fabric on the surfaces of said core and a cementitious material, including cut fiberglass roving strands, applied to the external surface of said fabric to a thickness of approximately $\frac{1}{4}$ to $\frac{1}{2}$ inch to secure said fabric to said core whereby said blocks have integrally related, load-bearing, tensile and fire-resistant characteristics.

12. A load-bearing building block comprising a foam core having a length up to sixteen feet and a height up to four feet and a cementitious coating on at least one surface, said coating including a reinforcement grid and cement composition having fiberglass roving strands mixed therein, said composition penetrating said grid and bonding said coating to said core, said core having a width which, when combined with the reinforced coating forms a load-bearing structure.

13. The block according to claim 12 wherein said grid is woven from fiberglass to form a perforate fabric.

14. The block according to claim 12 wherein said roving strands are cut to lengths of $\frac{1}{2}$ to $\frac{3}{4}$ inches.

15. A building formed from blocks according to claims 12, 13 or 14 wherein said blocks have foam cores six to twenty-four inches thick, each of said blocks having means on each edge for forming a joint with the adjacent blocks.

16. The building according to claim 15 wherein said joint means comprises a tongue on one edge of each block and a groove on the other edge of each block.

17. A building having external walls formed from a plurality of preformed load-bearing cement foam core blocks of a predetermined configuration adapted to be joined at their edges at the building site to form a rigid wall, each block comprising a foam core up to sixteen feet in length and four feet in height and of a sufficient width to be self-supporting, means on each edge of said core for matingly engaging the adjacent blocks and a cementitious coating on the exterior surface of said foam core to enhance the load-bearing capabilities of said wall, said coating including a reinforcing grid located on the surface of said core and a composition covering said grid, said composition including predetermined amounts of cement, sand, cut fiberglass rovings and a polymer adhesive, said grid being embedded in said composition and bonded to said core whereby said block has sufficient load-bearing strength to form the building walls.

18. The block according to claim 17 wherein said composition is applied to a maximum thickness of approximately ½ inch.

19. The block according to claim 17 wherein said core is approximately 6"–24" thick.

20. The block according to claims 17, 18 or 19 wherein said matingly engaging means compriss a tongue and groove joint on the opposite edges of each block.

21. The block according to claims 17, 18 or 19 wherein said matingly engaging means comprises a tapered groove in the edges of said blocks and a wire reinforced spline formed in the grooves in adjacent blocks to hold the blocks together.

22. The blocks according to claims 17, 18 or 19 wherein said matingly engaging means comprises an offset cut in each edge of the block which is symmetrical to the opposite edge, a semi-circular groove in said offset cut and a circular member positioned in said offset grooves in abutting edges.

23. The block according to claim 17 including means embedded in said blocks for securing interior wallboards to the blocks.

24. The blocks according to claim 17 wherein said building includes a floor formed from a plurality of said 4'×16' long (maximum) blocks, said floor blocks having a cementitious coating on both the upper and lower surfaces.

25. The building according to claim 17 including a roof formed of said blocks, said roof blocks having a cementitious coating on the exposed surfaces.

26. The building according to claim 25 wherein said roof blocks have a triangular cross section forming a pitched roof and flat ceiling.

* * * * *